US006612034B2

(12) United States Patent
Damstra

(10) Patent No.: US 6,612,034 B2
(45) Date of Patent: Sep. 2, 2003

(54) HAND-HELD ELECTRICAL APPLIANCE FOR PERSONAL CARE OR FOR USE AS A TOOL

(75) Inventor: Ate Klaas Damstra, Drachten (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/766,712

(22) Filed: Jan. 22, 2001

(65) Prior Publication Data

US 2001/0025421 A1 Oct. 4, 2001

(30) Foreign Application Priority Data

Jan. 24, 2000 (EP) ..... 00200247

(51) Int. Cl.[7] ..... B26B 19/38; B25F 5/00
(52) U.S. Cl. ..... 30/43.6; 30/43.1; 173/176
(58) Field of Search ..... 30/34.05, 43.6, 30/43, 43.1

(56) References Cited

U.S. PATENT DOCUMENTS 4,534,420 A * 8/1985 Goldelius ..... 173/176
5,687,481 A * 11/1997 De Boer et al. ..... 30/43.1
5,983,502 A * 11/1999 Geertsam et al. ..... 30/43.6
6,032,365 A * 3/2000 Hodges ..... 30/43.6
6,354,005 B1 * 3/2002 Bosch ..... 30/43.6

FOREIGN PATENT DOCUMENTS

GB 2328630 * 3/1999

* cited by examiner

*Primary Examiner*—Hwei-Siu Payer
(74) *Attorney, Agent, or Firm*—Ernestine C. Bartlett

(57) ABSTRACT

A hand-held electrical appliance (1) for personal care or for use as an electric tool, has a housing (2), manual actuating means (3), at least one force sensor (9) located in or on the housing (2) for supplying a sensor signal representative of the grip force exerted by the hand of a user, and control means for controlling at least one operational parameter of the appliance (1) in response to the sensor signal. In this way the user can consciously or unconsciously influence the motor speed or the spring load of the shaving heads of an electric shaver, or the motor speed of an electric drill.

10 Claims, 4 Drawing Sheets

HAND-HELD ELECTRICAL APPLIANCE FOR PERSONAL CARE OR FOR USE AS A TOOL

BACKGROUND OF THE INVENTION

The invention relates to a hand-held electrical appliance for personal care or for use as a tool, which appliance has a housing and manually operable actuating means.

Such electrical appliances are known in many versions. Examples are electric shavers and hair dryers but also electric drills etc. Electric shavers usually have a housing of a shape which during use is for the greater part enclosed by the hand of the user and which provides a convenient grip, and an on/off switch which needs to be actuated only at the beginning and at the end of a shaving session. Therefore, it is not necessary for the switch to be held constantly. However, influencing the operation of the shaver during a shaving session is not possible with customary shavers.

Other types of electrical appliances such as, for example, hair dryers and electric drills have a handle, often in the form of a pistol grip. Such appliances frequently have an on/off switch which takes the form of a trigger and which can also be utilized for varying the speed of the drive motor during use. As a result of the use of a trigger-type switch certain limitations are imposed on the designer as regards the design of the electrical appliance, while the user of appliance needs to hold the appliance in a manner which is not always optimal for the task to be performed.

BRIEF SUMMARY OF THE INVENTION

It is an object of the invention to provide another technique of controlling hand-held appliances. To this end, according to the invention, such an electrical appliance is characterized in that the appliance includes at least one force sensor arranged in or on the housing, for supplying a sensor signal which is representative of the force with which the housing is held in the hand of a user, as well as control means for influencing, in response to the sensor signal, at least one parameter relating to the operation of the appliance.

It is to be noted that aspects that play a part in the case of shavers are that different persons generally use a similar shaver in different ways and also that one person does not always handle the shaver in the same way during use thereof. Therefore, there is a need for a shaver which automatically adapts itself to the conditions during a shaving session, in such a manner that irritation of the skin is precluded.

One of the conditions which may vary for each person and for each shaving session, and even during one shaving session, is the force with which the shaver is applied to the skin.

The risk of pain or irritation increases as the shaver is pressed more firmly onto the skin. In accordance with the invention this effect is precluded or at least mitigated by utilizing the fact that, as is evidenced by tests, there is a relationship between the force with which a shaver is held and the force with which a shaver is applied to the skin in the sense that gripping the shaver more firmly also results in more force being exerted on the skin surface to be shaved. Thus, when the appliance is being normally held and operated, the user's hand will continuously exert force on the sensor, but the magnitude of that force may vary.

The invention will be described in more detail hereinafter with reference to the accompanying drawings.

DETAILED DESCRIPTION OF THE INVENTION

Figure 1:
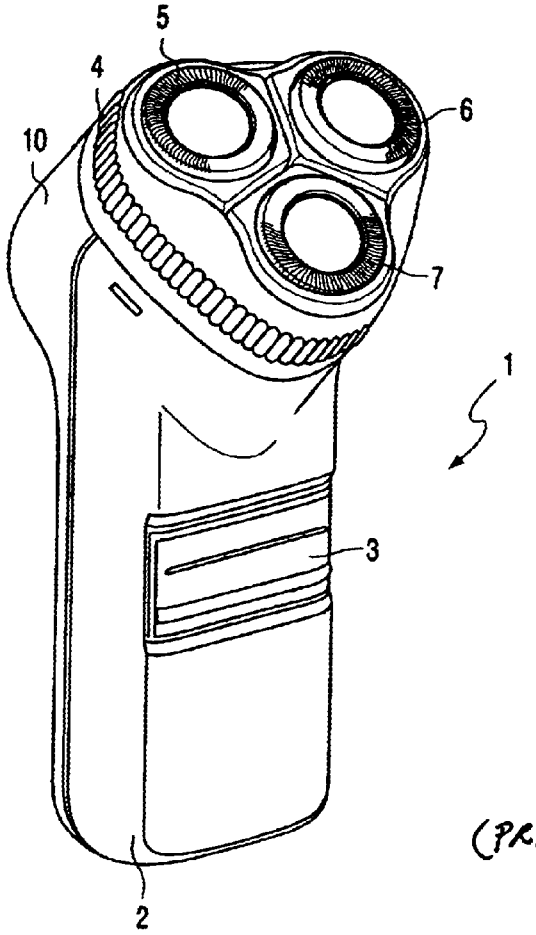
FIG. 1 (PRIOR ART)
FIG. 1 is a diagrammatic perspective view which shows an example of a known shaver to which the invention can be applied.

FIG. 1 is a diagrammatic perspective view which shows an example of a known electric shaver 1, as an example of an electrical appliance to which the invention can be applied. The shaver shown has a housing 2 which accommodates a drive motor, not shown, a power source and associated electrical leads and transmission elements. An on/off switch bears the reference numeral 3. The housing 2 carries a shaving-head holder 4, provided with three shaving heads 5, 6, 7 in the present example.

Figure 2:
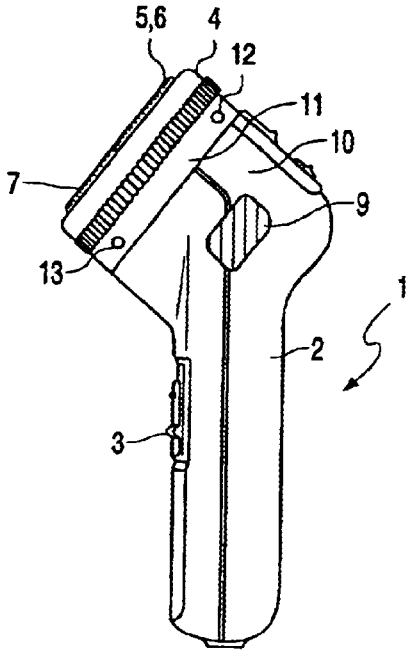
FIG. 2 shows diagrammatically an example of a shaver in accordance with the invention.

FIG. 2 shows a shaver 1 of a type similar to that in FIG. 1 but in a slightly different version. Like parts bear the same reference numerals as in FIG. 2. The shaver shown in FIG. 2 has at least one force sensor 9 arranged in one of the walls 10 of the housing of the shaver. The sensors are arranged at locations where the housing is held in the hand by the user during normal operation. The force sensors supply an electric sensor signal which is dependent on the force with which the shaver is held. Since, as already outlined hereinbefore, the magnitude of the grip force is indicative of the force with which the shaving heads are applied to the skin, the sensor signal can be utilized by the user to influence at least one of the factors or parameters which influence the shaving process. Possible irritation of the skin or pain can thus be reduced consciously as well as automatically and unconsciously.

By way of example, an electrical appliance having two force sensors 9 will be described in more detail hereinafter.

Figure 3:
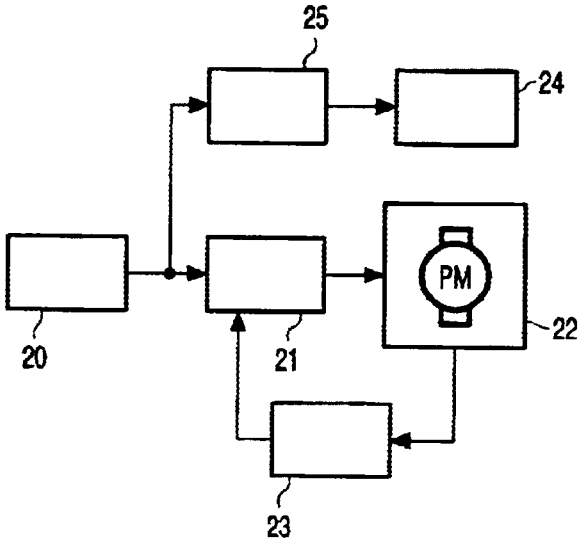
FIG. 3 is a block diagram of a first embodiment of an electrical appliance in accordance with the invention.
Figure 4:
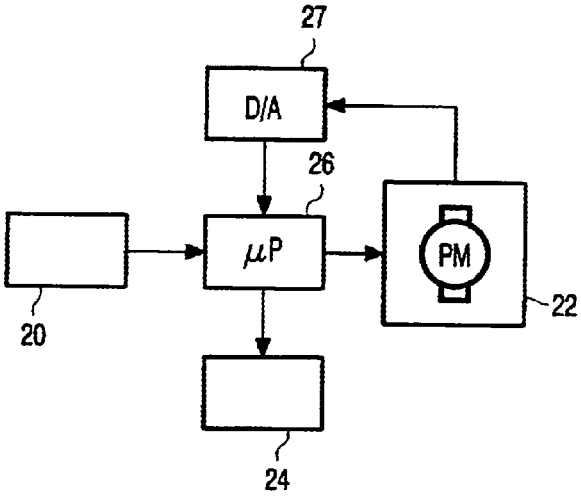
FIG. 4 is a block diagram of a second embodiment of an electrical appliance in accordance with the invention.

FIG. 3 is a block diagram of a sensor-controlled motor speed control system and FIG. 4 shows a digital variant. In FIG. 3 the block 20 represents a sensor, which supplies a sensor signal to a motor control circuit 21, which circuit controls a drive motor 22. The motor 22 provides feedback to the motor control circuit 21 via a feedback circuit 23. The block 20 may represent, for example, a force sensor as well as any amplifier and/or processing circuits for the sensor signal. A suitable force sensor is, for example, a strain dependent resistor. The resistance of resistors of this type decreases as the applied strain increases.

Figure 6:
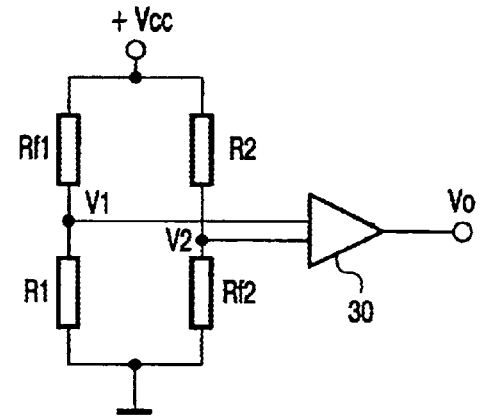
FIG. 6 shows an example of a sensor circuit for use in an embodiment of the invention.

If use is made of two force sensors in the form of strain dependent resistors arranged at opposite sides of the appliance housing, they may, for example, be included in a bridge circuit whose output signal is applied to the motor control circuit 21 via a suitable differential amplifier circuit. FIG. 6 shows an example. FIG. 6 shows a resistor bridge including fixed resistors R1 and R2 and strain-dependent resistors Rf1 and Rf2. The resistors Rf1 and R1 are arranged in series and so are the resistors R2 and Rf2. The resistors Rf1 and Rf2 are arranged diagonally opposed, as a result of which resistance variations of Rf1 and Rf2 influence the output voltage V1–V2 of the bridge circuit in the same sense. A differential amplifier 30 derives from the bridge output voltage V1–V2 a sensor signal Vo, which is applied to the motor control circuit 21.

If desired, the sensor action may be visualized. FIG. 3 shows a display device 24 for this purpose and a driver circuit 25 for the latter. The display device may be, for example, an LCD screen which displays digits and/or other characters representative of the sensor signal. Such a display device can be arranged at a suitable location in the housing 2. Alternatively, the display device may comprise one or more LEDs. Advantageously, use can be made of commercially available dual-color LEDs, which include one red and one green LED in one casing. When both LEDs are driven yellow light is emitted. In this way, three states can be displayed each with a separate color of light. For example, green light may be emitted in the case of a small grip force or also in the absence of a grip force, yellow light in the case of an average grip force, and red light in the case of a large grip force.

Figure 7:
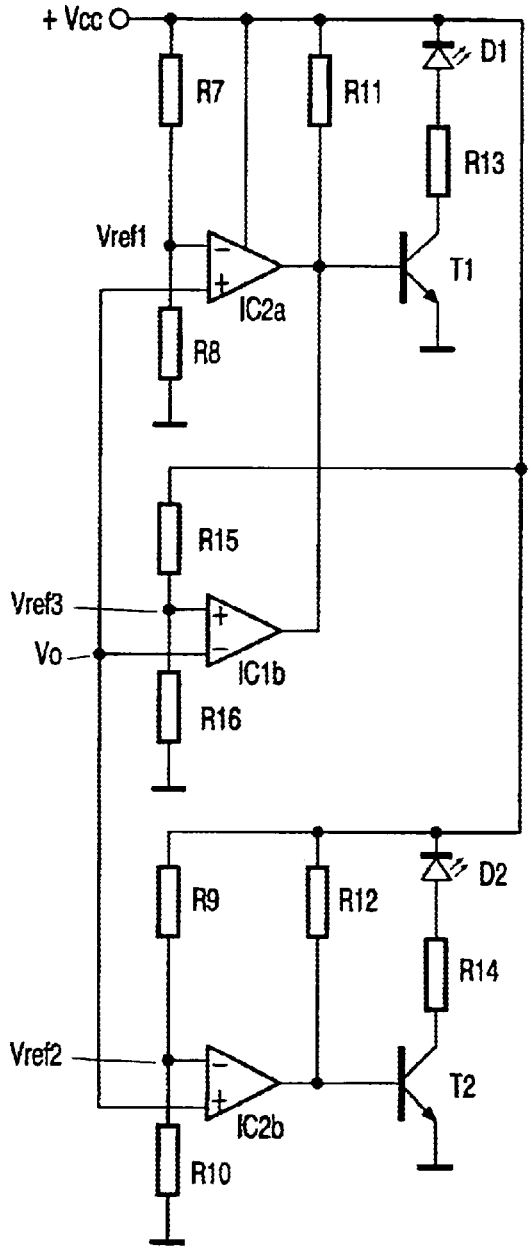
FIG. 7 shows an example of a display device including a driver circuit for use in an embodiment of the invention.

FIG. 7 shows, by way of example, a driver circuit for a red and a green LED. D1 is the green LED and D2 is the red LED. IC2*a* and IC2*b* are comparators and IC1*b* is an operational amplifier. The circuit is dimensioned in such a manner that the following Table applies:

| | | | |
|---|---|---|---|
| Vo < Vref1 | D1 on | red | F large |
| Vref1 < Vo < Vref2 | D1 + D2 on | yellow | F average |
| Vref2 < Vo < Vref3 | D2 on | green | F small |
| Vo < Vref3 | D1 + D2 off | — | F zero |

Herein, Vo is the sensor signal and F is the grip force. Vref1, Vref2 and Vref3 are reference voltages of the comparators and the operational amplifier.

It is possible to use several dual-color LEDs, for example three sets of two dual-color LEDs each, which in the case of a shavers are spaced apart along the periphery of the shaving head. FIG. 2 shows two dual-color LEDs 12, 13 arranged in the rim 11 of the shaving head 4. If desired, the two dual-color LEDs shown may be connected by a light guide, as a result of which a green yellow or red band of colored light is obtained between the dual-color LEDs 12 and 13.

In the case that the voltage supplied by the batteries or rechargeable batteries is inadequate to supply the LEDs and/or the circuits associated with the sensor(s) with the correct supply voltage it may be necessary to use a DC—DC converter. This technique is known per se and does not require any further explanation.

FIG. 4 shows a variant of FIG. 3, in which variant the motor is controlled by a microprocessor 26, which in this case receives the sensor signal in digital form and which drives the display device 24 and controls the motor 22. By means of a D/A converter 27 feedback is provided from the motor 22 to the microprocessor.

Figure 5:
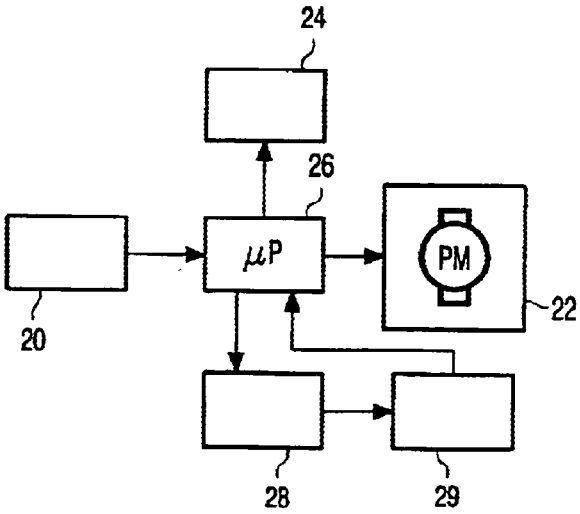
FIG. 5 is a block diagram of a third embodiment of an electrical appliance in accordance with the invention.

FIG. 5 shows another variant in which for an electric wet shaver an additive is supplied in dependence on a sensor signal.

FIG. 5 also shows a microprocessor 26 which receives a sensor signal and which controls a display device 24 and an additive generator 28. If desired, the additive, for example a shaving cream, can be detected by means of a sensor 29, which supplies a feedback signal to the microprocessor. In addition, the microprocessor may be used to adapt the motor speed.

Figure 8:
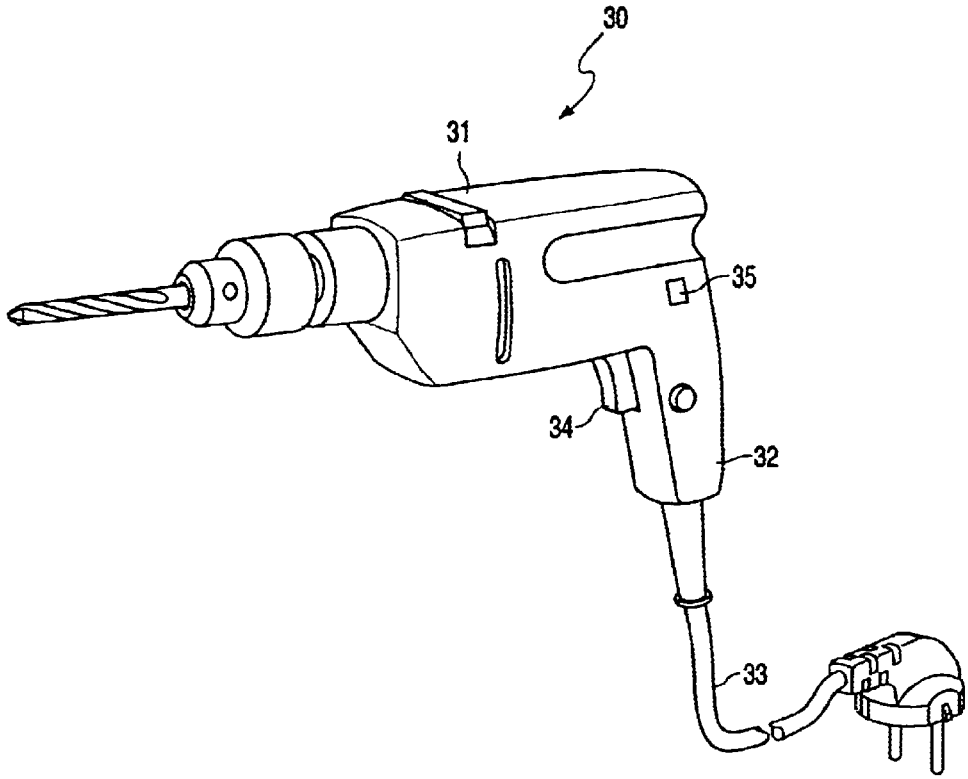
FIG. 8 shows diagrammatically an example of a hand-held electric tool in accordance with the invention.

FIG. 8 shows diagrammatically an example of an electric drill 30 having a housing 31 provided with a pistol grip 32, a power cord 33 and a customary trigger-type switch 34. The housing has further been provided with at least one force sensor 35 arranged at a location which need not necessarily correspond to that shown in the drawing. The at least one force sensor can be used, for example, for speed control. The customary trigger-type switch 34 may be dispensed with or may be used for switching on/off as well as speed control or only for switching on/off. Alternatively, the trigger-type switch 34 may be replaced by an on/off switch arranged at a suitable location on the housing.

What is claimed is:

1. An electrical appliance (1) arranged for holding in one hand of a user while being normally operated, comprising:

a housing (2), manually operable actuating means (3) provided at a surface of the housing, wherein said manually operable actuating means is an on/off switch, and additional means, in addition to said manually operable actuating means, for influencing at least one parameter relating to the operation of the appliance, characterized in that said additional means includes:

a force sensor (Rf1, Rf2) arranged at a location in a side wall of said housing where, when the appliance is being normally held and operated, said one hand of the user will continuously exert force on the sensor, said force sensor supplying a sensor signal which is representative of the force with which the housing (2) is held in said one hand, and control means (21, 26) for influencing, in response to the sensor signal, said at least one parameter, and further characterized in that the additional means comprises two said force sensors arranged respectively at opposite sides of the housing, and said control means comprises a bridge circuit to which the two force sensors are connected for influencing said at least one parameter.

2. A hand-held electrical appliance (1) for personal care or for use as a tool, which appliance has a housing (2) and manually operable actuating means (3), characterized in that the appliance (1) includes two force sensors (Rf1, Rf2) arranged in or on the housing at opposite sides of the housing and electrically connected in a bridge circuit, for supplying a sensor signal which is representative of the force with which the housing (2) is held in a hand of a user, as well as control means (21, 26) for influencing, in response to the sensor signal, at least one parameter relating to the operation of the appliance (1).

3. An electrical appliance as claimed in claim 1, characterized in that the appliance is a shaver having a motor and one or more shaving heads, and the at least one parameter relating to the operation of the appliance is a parameter relating to the shaving process and belonging to a group of parameters comprising the motor speed, the shaving head level, the angles of the shaving heads with respect to one another if more than one shaving head is used, a spring force applied to the shaving heads, and the supply of shaving additive.

4. An electrical appliance as claimed in claim 2, taking the form of an electric shaver, characterized in that the appliance is a shaver in which the control means control a supply of shaving additive.

5. An electrical appliance as claimed in claim 2, in which the appliance is a hand-held electric tool.

6. A hand-held electrical appliance (1) for personal care or for use as a tool, said appliance having a housing (2) and manually operable actuating means (3), characterized in that the appliance (1) includes at least one force sensor (9) arranged in or on the housing for supplying a sensor signal which is representative of the force with which the housing (2) is held in a hand of a user, as well as control means (21, 26) for influencing, in response to the sensor signal, at least one parameter relating to the operation of the appliance (1), and further characterized in that said appliance includes display means driven by the sensor signal, which display means comprises a plurality of spaced-apart LEDs (12, 14), which LEDs comprise a plurality of pairs of LEDs (12, 13) accommodated in said housing, each pair comprising one green LED and one red LED, and the LEDs of a pair being driven separately so as to emit green or red light, and being also drivable simultaneously to emit yellow light.

7. An electrical appliance as claimed in claim 6, characterized in that said plurality of pairs comprises two spaced-apart pairs of LEDs (12, 13) coupled via a light guide.

8. An electrical appliance as claimed in claim 6, characterized in that a driving circuit (IC2*a,* IC2*b,* IC1*b*) for the LEDs has been provided to drive the red LEDs exclusively in the case of a large grip force, to drive both the red and the green LEDs to emit yellow light in the case of an average grip force, and to drive the green LEDs exclusively in the case of a small grip force.

9. An electrical appliance as claimed in claim 6, characterized in that the appliance is a shaver having a motor, one or more shaving heads, and the at least one parameter relating to the operation of the appliance being a parameter relating to the shaving process and belonging to a group of parameters comprising the motor speed, the shaving head level, the angles of the shaving heads with respect to one another if more than one shaving head is used, a spring force applied to the shaving heads, and the supply of shaving additive.

10. An electrical appliance as claimed in claim 6, taking the form of an electric shaver, characterized in that the appliance is a shaver in which the control means control a supply additive.

* * * * *